US007032423B2

(12) United States Patent
Caporusso

(10) Patent No.: US 7,032,423 B2
(45) Date of Patent: Apr. 25, 2006

(54) HYDRAULIC CIRCUIT FOR LINEARLY DRIVING A MACHINE-TOOL SLIDER IN BOTH DIRECTIONS

(75) Inventor: Alessandro Caporusso, Piedimonte San Germano (IT)

(73) Assignee: CML International S.p.A., Piedimonte San Germano (IT)

( * ) Notice: Subject to any disclaimer, the term of this patent is extended or adjusted under 35 U.S.C. 154(b) by 116 days.

(21) Appl. No.: 10/784,229

(22) Filed: Feb. 24, 2004

(65) Prior Publication Data

US 2004/0168498 A1 Sep. 2, 2004

(30) Foreign Application Priority Data

Feb. 28, 2003 (IT) ..... RM2003A000089
Jun. 12, 2003 (IT) ..... RM2003A000294

(51) Int. Cl.
*B21D 11/00* (2006.01)

(52) U.S. Cl. ..... 72/175; 72/453.01

(58) Field of Classification Search ..... 72/175, 72/149, 453.01, 453.02
See application file for complete search history.

(56) References Cited

U.S. PATENT DOCUMENTS 3,700,396 A * 10/1972 Adams ..... 91/449
3,820,439 A * 6/1974 Cudnohufsky ..... 91/37
4,170,124 A * 10/1979 MacGregor ..... 72/389.3
4,918,958 A 4/1990 Glomb et al.
5,297,469 A * 3/1994 Raymond ..... 91/291
5,542,275 A * 8/1996 Smith et al. ..... 72/90
5,678,441 A 10/1997 Schwarze
6,173,598 B1 1/2001 Caporusso et al.

FOREIGN PATENT DOCUMENTS

DE 2257368 6/1974
DE 19751504 7/1998
WO WO 03/008126 1/2003

* cited by examiner

*Primary Examiner*—Daniel C. Crane
(74) *Attorney, Agent, or Firm*—Young & Thompson

(57) ABSTRACT

A hydraulic circuit for linearly driving a machine-tool slider in both directions, comprising an hydraulic cylinder (5) whose piston rod (4) is connected to a slider and which is fed with pressurized fluid from a reservoir (14) by a pump (15) through a three-position four-way valve (18), a check valve (12-13), and between the last ones, a pair of throttling valves (19, 19') which are mounted symmetrically each other and operated to generate an increased pressure in either one or the other chamber, which is at the moment in a low pressure, of the hydraulic cylinder (5) in order to slow down said slider in its work motion in both directions of linear travelling when a programmable interval is approached from a predetermined position for each working pass.

Situated in the bypass (190, 190') of each throttling valve (19, 19'), among the same valves (19, 19') and the hydraulic cylinder (5), is a manual flow control valve (20, 20').

10 Claims, 6 Drawing Sheets

HYDRAULIC CIRCUIT FOR LINEARLY DRIVING A MACHINE-TOOL SLIDER IN BOTH DIRECTIONS

BACKGROUND OF THE INVENTION

This invention relates to a hydraulic circuit for linearly driving a machine-tool slider in both directions.

Such a slider is for example a slider holding a movable roller in a pipe bending machine. However, such a slider can also belong to a press, to a bending machine, to a fixed radius pipe bender or another machine, in which such a slider must be moved to a certain position quickly and accurately. For simplicity and clarity sake a pyramidal, symmetrical pipe bending machine is referred to below as a machine tool.

The patent application PCT/IT 01/00381 of the same applicant provides a hydraulic circuit for linearly driving a movable roller-holder slider of a pipe bending machine, comprising an hydraulic cylinder whose piston rod is connected to such a slider that travels in its primary or work motion to a predetermined position for each pass of one or more passes of working operation of a workpiece to be bent, and in its return motion to a rest position, the hydraulic cylinder having a high pressure chamber and a low pressure chamber. Both chambers are communicating with respective ducts of pressurized fluid fed from a reservoir by a pump, ducts on which a three-position four-way valve and a check valve operate. The hydraulic circuit further comprises, between the three-position four-way valve and the check valve, a throttling valve, that is operated by an electromagnet to generate an increased pressure in the low pressure chamber in order to slow down the slider holding the upper roller in its primary motion when a programmable interval is approached from the predetermined position for each working pass.

The hydraulic circuit above mentioned allows the pressures between two chambers to be balanced, until to stop the slider exactly in the desired position in a unidirectional work travel, while in the other direction, or return travel of the slider, the stop accuracy of the same is coarse.

Thus, a problem of the stop accuracy of that slider when the return travel is also a work travel arises. This occurs for example, when an elongated workpiece must be bent in one or more passes with connections between contiguous curves having different radiuses. In these events the slider is necessarily moved to work positions in both directions.

SUMMARY OF THE INVENTION

In particular, an object of the present invention is to allow a machine tool to operate, determining with precision the position (stop or motion reversal) of a slider in both directions of a work travel, without requiring a mechanical stop device.

Therefore, the present invention according to a first embodiment thereof provides a hydraulic circuit for linearly driving a machine-tool slider in both directions, comprising an hydraulic cylinder whose piston rod is connected to a slider that travels until a first predetermined position for each pass of one or more passes of working operation of a workpiece to be bent, the hydraulic cylinder having two chambers, both chambers, in order to be in high and low pressure alternatively, communicating with respective ducts of pressurized fluid fed from a reservoir by a pump, on which ducts a three-position four-way valve, a check valve, and between the last ones, a first throttling valve operate, the throttling valve, that is operated to generate an increased pressure in a chamber, which is at the moment in a low pressure, in order to slow down said slider in a first work motion when a programmable interval is approached from said first predetermined position for each working pass, characterized in that the hydraulic circuit comprises a second throttling valve, which is mounted in a bypass symmetrically opposite to said first throttling valve and operated to generate an increased pressure in said other chamber, which is at the moment in a low pressure, in order to slow down said slider in a second work motion when a programmable interval is approached from a second predetermined position for each working pass.

However, according to the first embodiment of the present invention the automatic operation of the throttling valves performs the flow branching with a flow rate, which is reduced but fixed. As a consequence, also the speed of the slider in its approaching to said programmable interval is constant.

If an user such as a blacksmith cannot modify the speed of the slider, he is not able to demonstrate his ability in achieving accurate round shapes, that need a perfect mirror symmetry, in a section bar. Only by acting on the velocity of penetration of a tool, such a deforming roller which is held by the slider, the kind of material of that section bar can be taken in account. In other words, not accurate round shapes are achieved, if the deforming roller is moved with an exaggerated speed with respect to the kind of material of said section bar.

Further, different capacities of the two chambers of the hydraulic cylinder due to the presence of the piston rod cannot be taken into account. As a result of this it is impossible to have an equal pressure in both chambers of the hydraulic cylinder. Thus, even if the reduced flow rate is the same, a piston is moved in one direction stroke with both speed and stop distance that are different from those in the other direction stroke.

In order to overcome the drawback above cited, a second embodiment of the invention provides a hydraulic circuit as above described further having in said bypass of each throttling valve a manual flow control valve, able to reduce farther adjustably a flow rate through the throttling valve of the fluid being discharged from the chamber that is at the moment in a low pressure, so that a back pressure is generated in said low pressure chamber.

According to this second embodiment of the invention, it is possible to make optimal a deformation work of a metal material by adjusting the deformation rate of a section bar or other workpiece by acting on the accurate control of the speed of a machine-tool slider.

BRIEF DESCRIPTION OF THE DRAWINGS

The invention will be now described with reference to its embodiments, although it has to be understood that modifications can be made to the invention without departing from the spirit thereof, with reference to the figures of the accompanying drawing, in which.

DETAILED DESCRIPTION OF THE INVENTION

Figure 1:
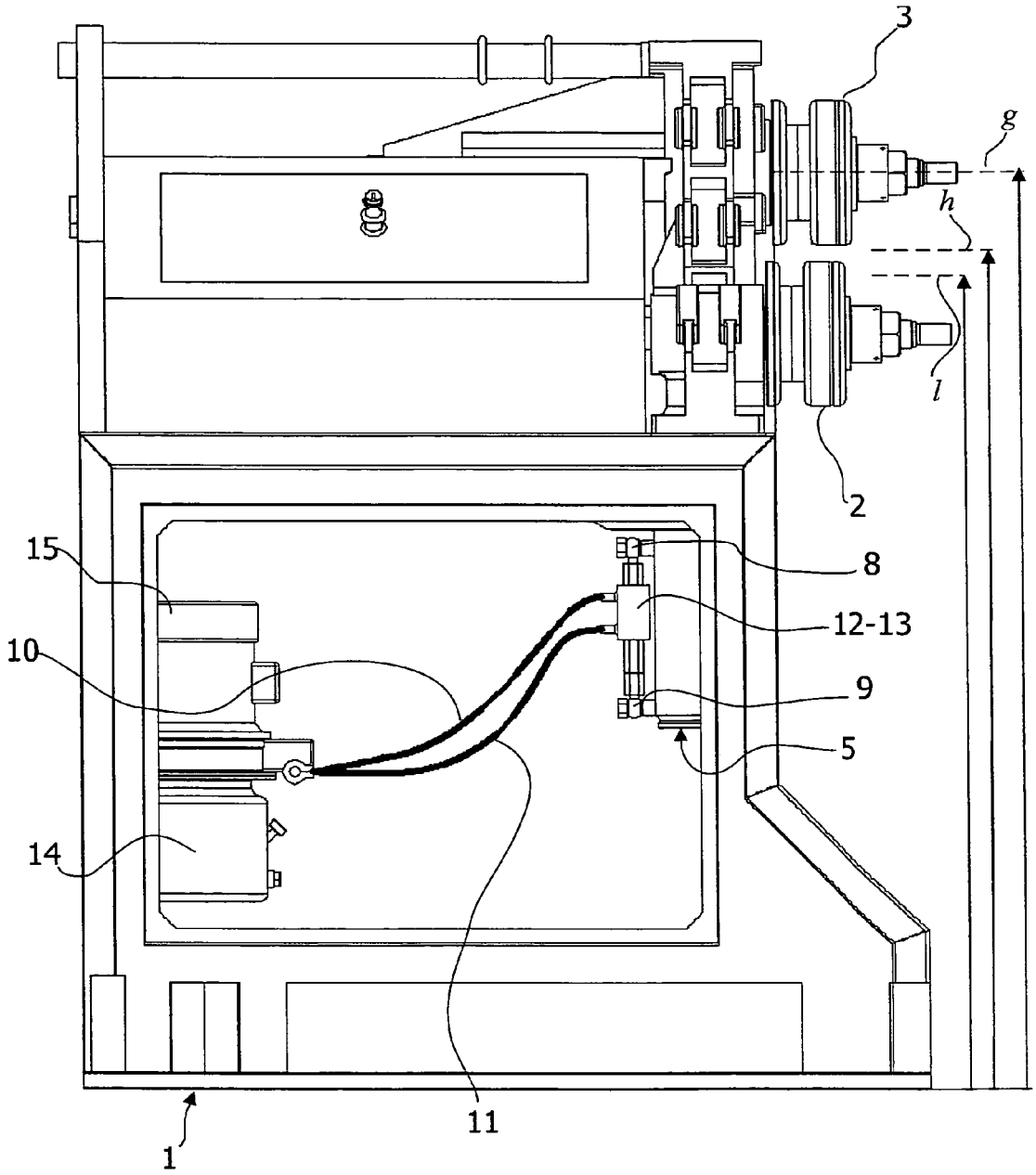
FIG. 1 shows a diagrammatic side view of a partially opened pipe bending machine, to which a first embodiment of a hydraulic circuit according to the invention is applied.

Referring to the drawings, the general appearance of a pipe bending machine, generally denoted as 1, is shown, as an example of machine tool in FIG. 1. The pipe bending machine 1 is equipped with a hydraulic circuit according to a first embodiment of the invention.

The pipe bending machine shown by way of example is of a symmetrical pyramidal kind. It has frontally (on the right hand side in FIG. 1) a pair of fixed lower rollers (only one roller, denoted as 2, is shown) and an upper or deforming roller 3. The upper roller 3 is mounted conventionally on a slider (not shown) that is connected to a piston rod 4 diagrammatically represented in FIG. 2. The piston rod 4 is a part of a hydraulic cylinder 5 having an upper chamber 6 and a lower chamber 7.

Owing to the motion of the piston rod 4, the slider holding the upper roller 3 is movable downward during a primary or work motion from a general position indicated by an axis g to a predetermined position of axis l, as shown in an explanatory way in FIG. 1. The bending operation of a workpiece (not shown) is performed during a travel including one pass or more. In every pass, said predetermined position of axis l is selected for each workpiece. If e.g. it is intended that two equal workpieces to be bent are worked by two passes, and an equal end position of pipe bending, but a different intermediate position is chosen for every workpiece to be bent, two workpieces with different dimensional characteristics would be obtained.

One would appreciate the importance that bending positions are achieved exactly as much as possible.

Figure 2:
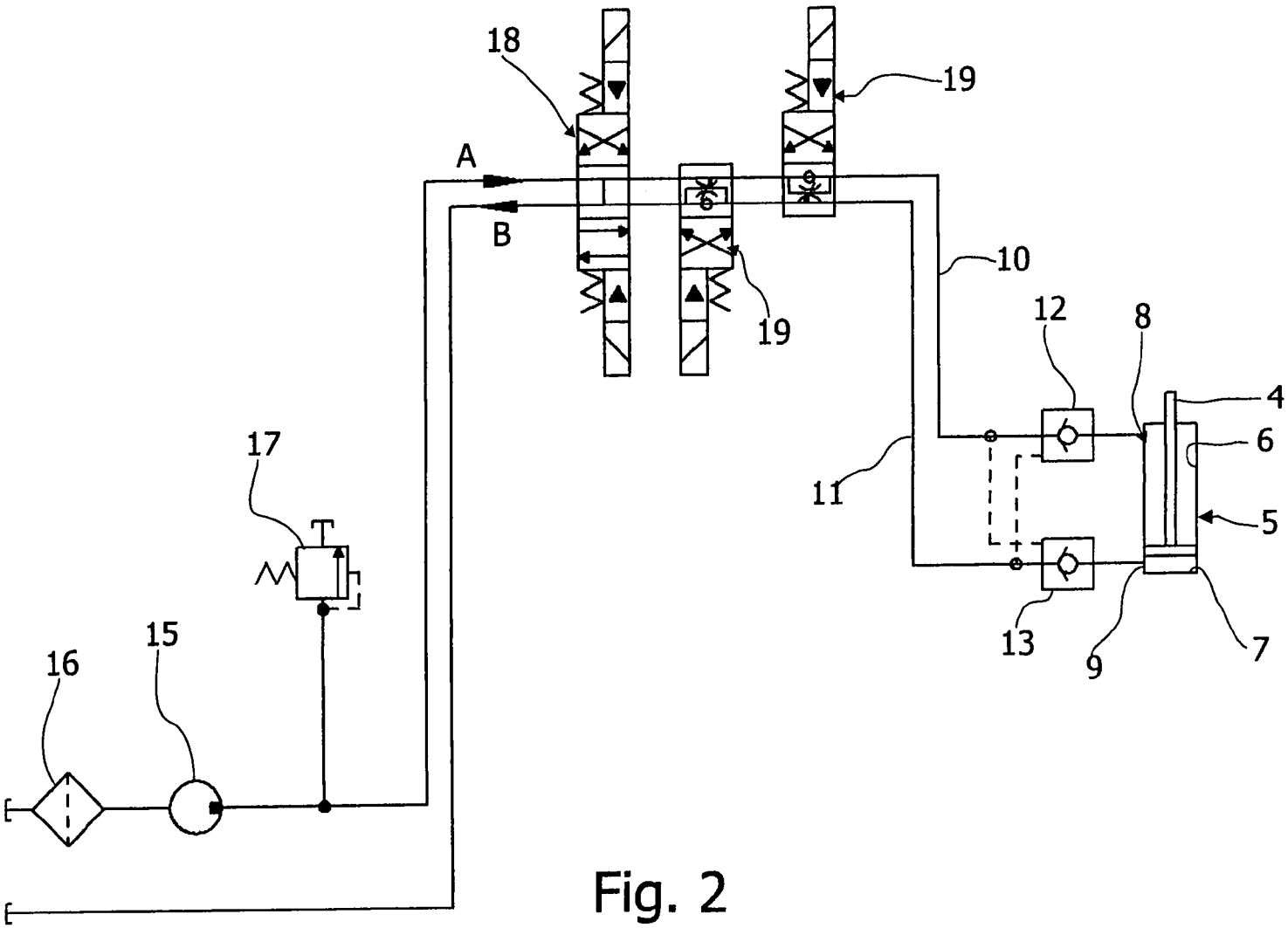
FIG. 2 shows a diagram of the first embodiment of a hydraulic circuit according to the invention.

As constructively and diagrammatically shown in FIGS. 1 and 2 respectively, the upper chamber 6 and the lower chamber 7 of the hydraulic cylinder 5 are communicating through their ports 8 and 9 with respective ducts 10 and 11 of pressurized fluid, and a pilot-operated to close check valve, that consists of a pair of single-acting valve 12 and 13, is provided.

A pressurized fluid, in general oil for hydraulic circuits, is fed from a reservoir 14 through a motor-pump unit 15. As best shown in FIG. 2, at least a filter 16 and a pilot-operated safety valve 17 are provided in the circuit of the pump. Further conventionally, a three-position four-way valve 18 operates on both ducts 10 and 11. The valves, as well as the pump, are controlled by an electronic control unit (not shown).

According to a first embodiment of the invention, a pair of throttling valves 19, 19', which are positioned symmetrically opposite to each other, is joined to the valve 18 on the same ducts 10 and 11.

The throttling valves 19, 19' are represented in FIG. 2 as electromagnetically controlled valves, but naturally it is possible that they are controlled by a pneumatic and/or hydraulic circuit or equivalent.

The throttling valves 19, 19', which are operated e.g. by said electronic control unit (not shown) or also in another way, generate a back pressure in the lower chamber 7 of the hydraulic cylinder 5 or vice versa in the upper chamber 6. In fact, in the downward travel of the movable roller 3, when the predetermined bending position which is defined by the axis l of the movable roller is approached, it is suitable to slow down the slider so that the last one can reach exactly the bending position. This deceleration, e.g. from the position of axis h is obtained by operating, as desired, the throttling valve 19 in order to gradually slow down the movable roller travelling downward, up to the complete closure of the valve in the desired end position for the bending pass that is being performed.

The interval h-l inside which the slow down is performed is programmable according to the desired precision.

Let us suppose that we must move back with accuracy the slider into the bending position with axis g during the upward travel of the movable roller 3. When the movable roller 3 approaches that predetermined position, it is suitable to slow down the slider so that the movable roller 3 can achieve with precision the bending position. Similarly to the downward motion, this deceleration is obtained through the operation, as desired, of the throttling valve 19' in such a way to reduce gradually the speed of upward travel of the movable roller, until that the throttling valve 19' is completely closed in the desired final position for the bending pass which is being performed. This deceleration is obtained through the combined operation of the three-position four-way valve 18 and the throttling valve 19', as described in the previous patent application PCT/IT 01/00381 of the same applicant.

Figure 3:
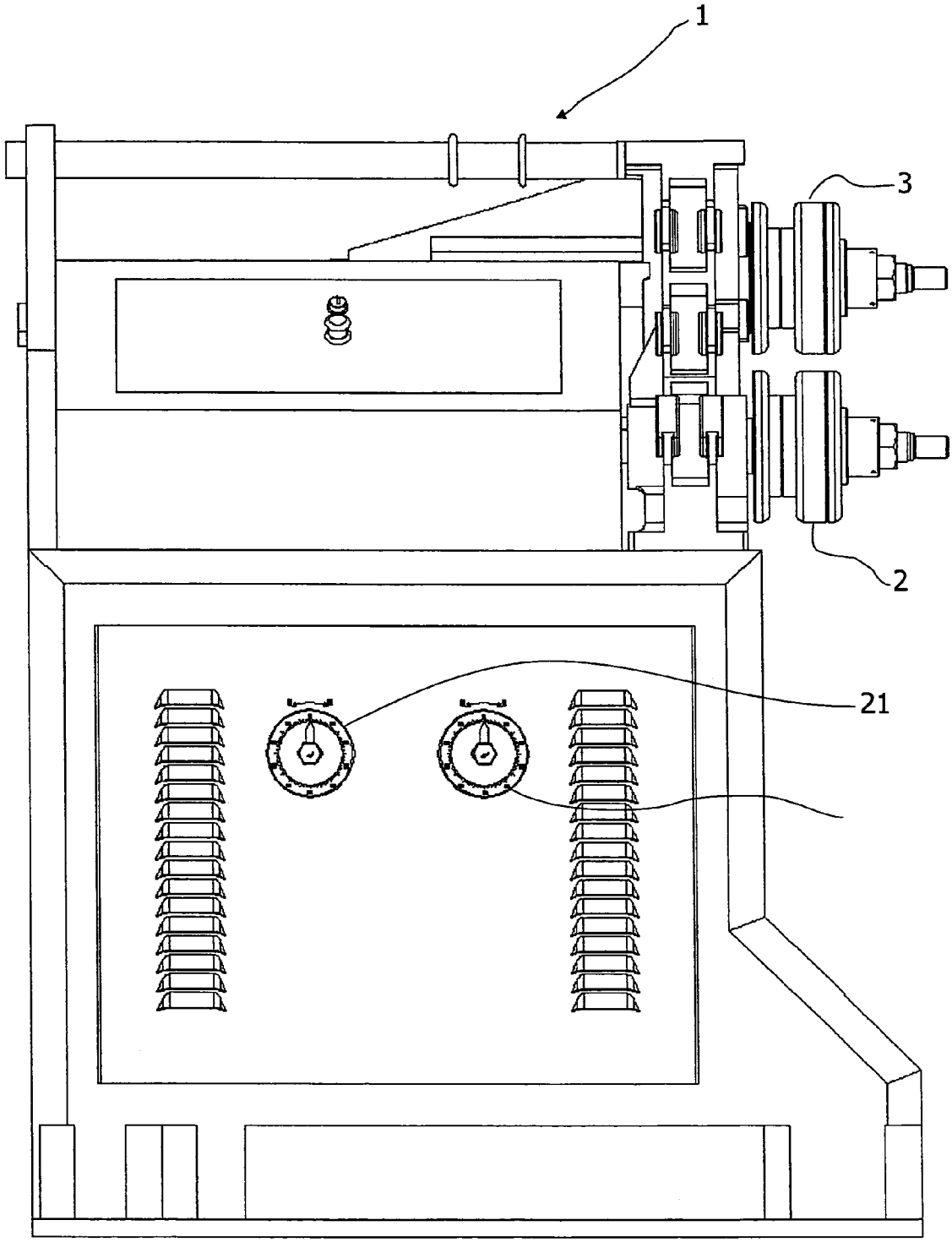
FIG. 3 shows a diagrammatic side view of a pipe bending machine, to which a second embodiment of a hydraulic circuit according to the invention is applied.
Figure 4:
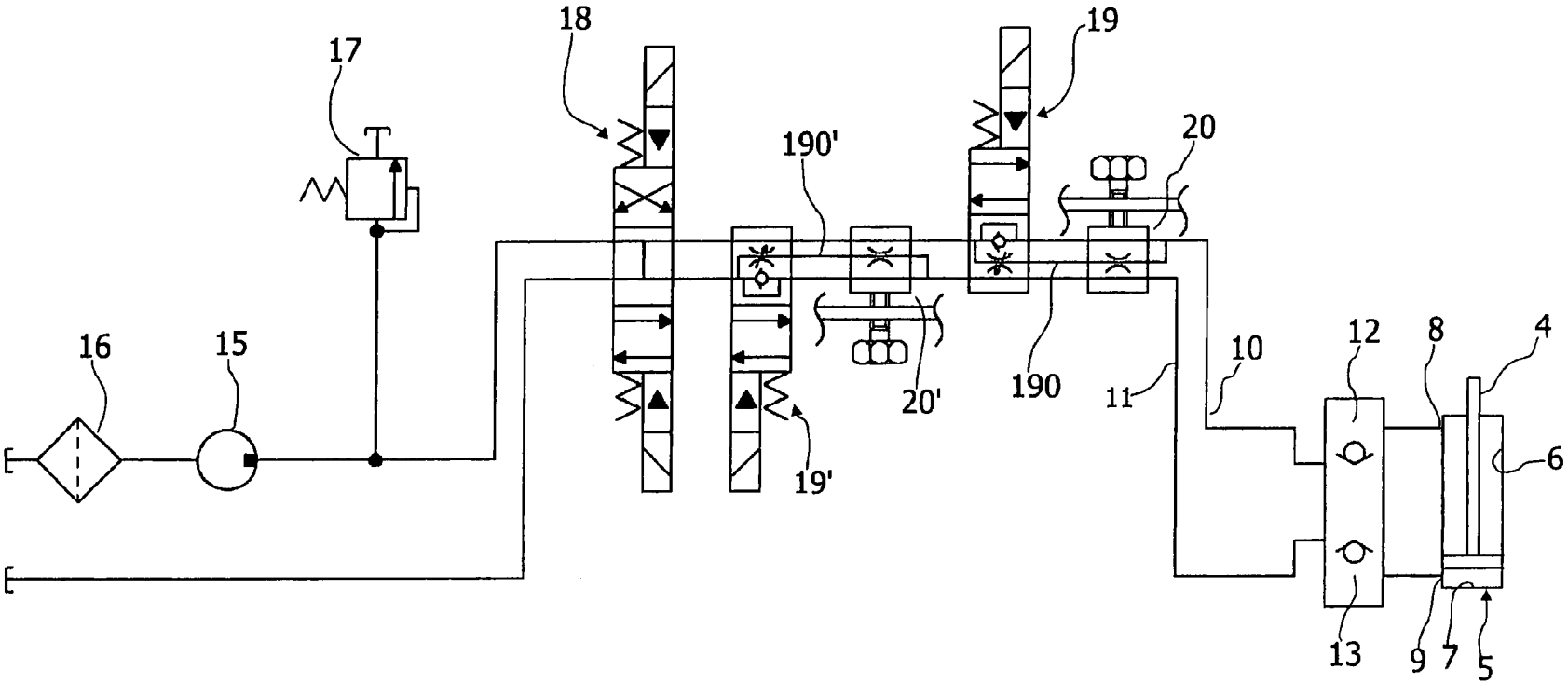
FIG. 4 shows a diagram of the second embodiment of a hydraulic circuit according to the invention.

Reference is made to FIGS. 3 and 4, in which a pipe bending machine 1' is diagrammatically shown. A second embodiment of an hydraulic circuit according to the invention is applied to the pipe bending machine 1'. Also in FIGS. 3 and 4 same or similar numbers are used to indicate same or similar parts. The throttling valves 19, 19' have respective bypass 190, 190' with throttled cross-section determining a reduced fixed flow rate among the same valves and the hydraulic cylinder 5.

Situated on the bypasses 190, 190' of the throttling valves 19, 19' are manual flow control valves 20, 20', able to reduce adjustably a flow rate of the fluid through the throttling valves 19, 19'. The valves 20, 20' can be controlled through respective knobs 22.

Figure 5:
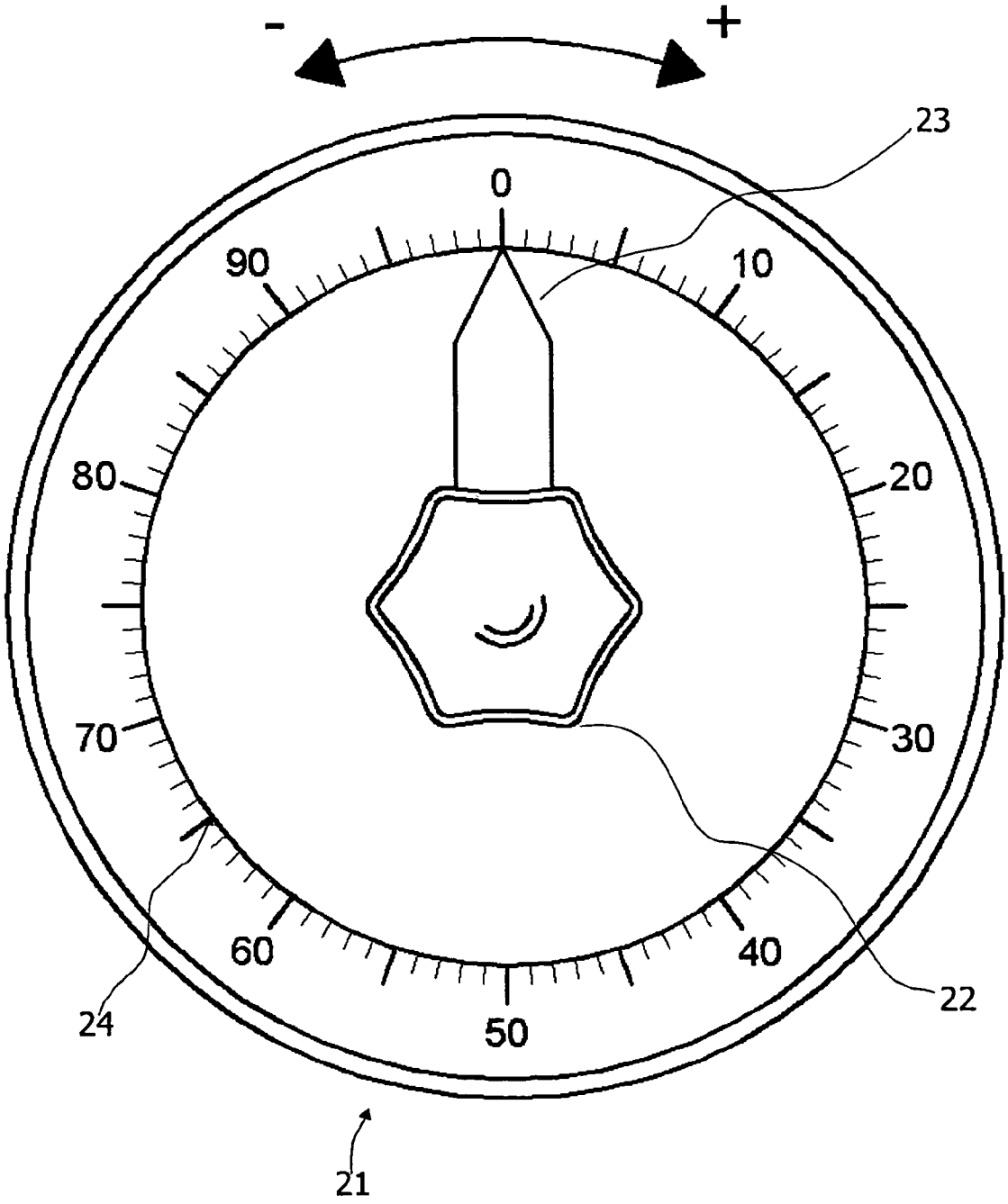
FIG. 5 shows an enlarged view of a control dial of the operation of a valve used in the pipe bending machine of FIG. 3.

Advantageously, the valves 20, 20' can be controlled on the side of the bending machine, as shown in FIG. 3. In FIG. 5, which is an enlarged view of control means of the flow control valves 20, 20', control means is shown as comprising control dials designated in general as 21, 21. Each control dial 21 has centrally a knob 22 to which a pointer 23 is connected. The bottom of the dial is a graduated scale in percentage. When the pointer 23 is placed on "0", the flow control valve 20, 20' is not operative. By moving the pointer 23 clockwise the flow rate is reduced, and anticlockwise vice versa. The percentage of the required reduction of flow rate is displayed by the graduated and numbered scale 24.

The main advantage of the second embodiment of the present invention when used on a pipe bending machine is to influence the vectorial composition of the motions of the slider holding the deforming/drawing roller 3 and of the workpiece which is fed by the lower roller 2, 2, without requiring an adjustment of the speed of rollers 2, 2, and 3, achieving a centesimal precision.

Figure 7:
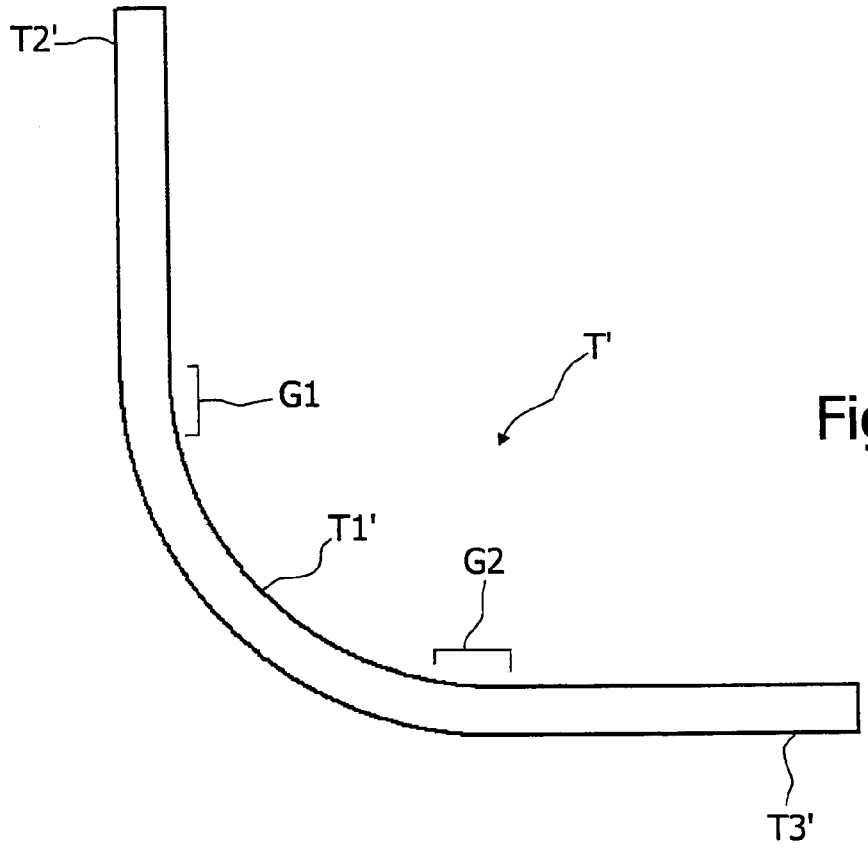
FIG. 7 shows in a diagrammatic side view a section of metal pipe bent by a pipe bending machine as that shown in FIG. 4.
Figure 6:
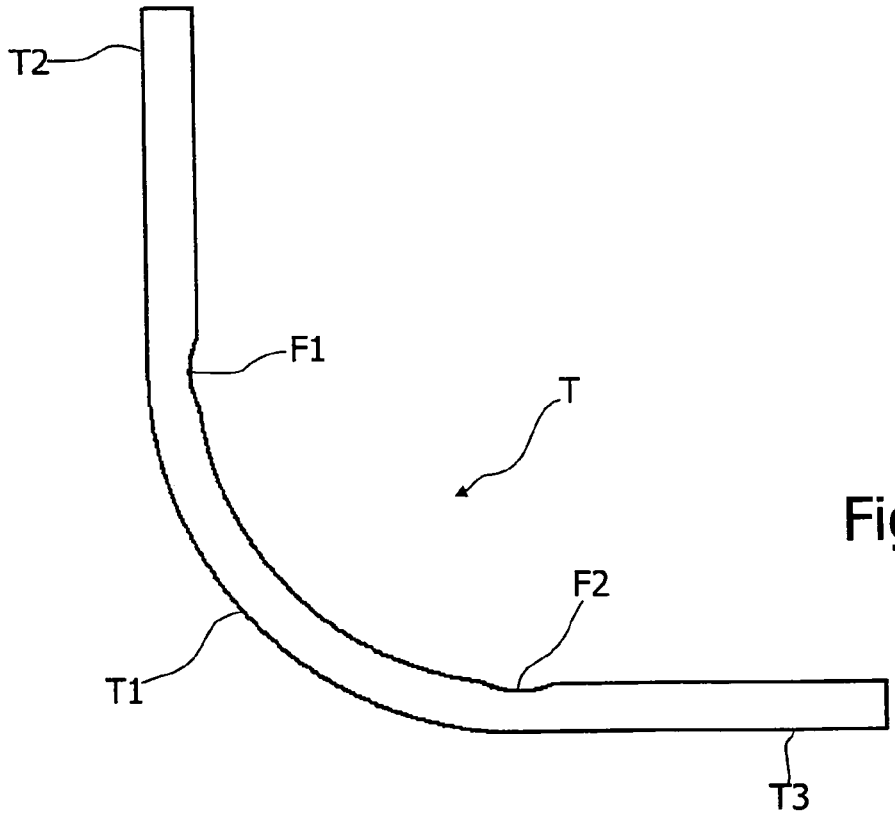
FIG. 6 shows in a diagrammatic side view a section of metal pipe bent by a pipe bending machine without the hydraulic circuit according to the invention.

The influence of the hydraulic circuit according to the invention in a pipe bending machine is shown in FIGS. 6 and 7, which are diagrammatic side views of a section T, T' of metal pipe bent by a bending machine respectively without and with a hydraulic circuit according to the second embodiment of the invention. By way of example, the section T, T' of metal pipe has a central portion T1, T1' with constant bending radius and two generally straight end portions T2, T3 and T2', T3'.

In FIG. 6 a section of pipe T is shown after worked in which a transition zone of the straight portion T2, T3 to the bent portion T1 and vice versa presents a recess, essentially a notch, indicated with F1 and F2 respectively, which prevents two adjoining portions T2, T1 and T1, T3 from being connected geometrically with continuity. This is by virtue of the fact that, while the lower rollers 2, 2 of the bending machine, feed the metal pipe T, the deforming/drawing 3 does not reduce in time its speed and penetrates sharply the material at the start of the bending, and comes out too slowly at the end of the bending, "leaving its sign".

In FIG. 7 a section of pipe T' is shown after worked in which the transition zone of the straight portion T2', T3' to the bent portion T1' and vice versa do not show any recess or lack of continuity in the zones indicated with G1 and G2 respectively, and then an optimal connection between two adjoining portions T2', T1' and T1', T3'. This is by virtue of the fact that, while the lower rollers 2, 2 of the bending machine, feed the metal pipe T', the deforming/drawing roller 3 reduced in time its speed and then approached the pipe being bent and moved apart from it respectively with precision.

A person skilled in the art knows that a reduction of the approaching speed and an increase of the removing apart speed, with respect to the section of the metal pipe to be worked can be obtained by providing a bending machine with an adjuster of the rotation speed of the lower rollers 2, 2 and of the deforming/drawing roller 3.

Since the present invention compensates very well the lack of such a speed adjuster, the invention can obtain a great saving of machine cost. Thus, with the hydraulic circuit according to the invention, a high quality is reached in bending workpieces with centesimal approximation, above all assuring that an accurate bending can be repeated without sophisticated, expensive and complex apparatuses.

Obviously the hydraulic circuit of the present invention can be used also in other machine tools in which an accurate positioning of a member driven by a hydraulic cylinder slider.

A further characteristic of the present invention takes into account the presence, in the upper chamber 6 of the cylinder 5, of the piston rod 4, which implies an oil volume inside the chamber 6 less than in the lower chamber 7. It should be appreciated that an equal flow rate in the bypass 190, 190' implies a different speed of the piston when either one or the other throttling valve 19, 19' is operated. To overcome this problem, i.e. to reach such a pressure field inside two chamber 6 and 7 of the cylinder 5 to obtain an annulment of the difference of speed of the slider 3 in its strokes in both directions, the throttled cross-section in the throttling valve 19 of the duct 10 communicating with the cylinder chamber 6 having the piston rod 4 is wider than the throttled cross-section in the throttling valve 19' of the duct 11.

The present invention has been described with reference to two specific embodiment thereof, but it would be expressly understood that modifications, addition and/or omissions can be made without departing from the spirit of invention as defined in the enclosed claims.

I claim:

1. A hydraulic circuit for linearly driving a machine-tool slider in both directions, comprising a hydraulic cylinder (5) whose piston rod (4) is connected to a slider that travels until a first predetermined position for each pass of one or more passes of working operation of a workpiece to be bent, the hydraulic cylinder having two chambers (6, 7) in one of which there is the piston rod (4), both chambers, in order to be in high and low pressure alternatively, communicating with respective ducts (10, 11) of pressurized fluid fed from a reservoir by a pump (15), ducts (10, 11) on which a three-position four-way valve (18), a check valve (12-13), and in a bypass (190) between the check valve and the fourway valve, a first throttling valve (19) operate, the throttling valve (19), that is operated to generate an increased pressure in a chamber (6, 7), which is at the moment in a low pressure, in order to slow down said slider in a first work motion when a programmable interval is approached from said first predetermined position for each working pass, characterized in that the hydraulic circuit comprises a second throttling valve (19'), which is mounted in a bypass (190') symmetrically opposite to said first throttling valve (19) and operated to generate an increased pressure in said other chamber, which is at the moment in a low pressure, in order to slow down said slider in a second work motion when a programmable interval is approached from a second predetermined position for each working pass.

2. The hydraulic circuit according to claim 1, characterized in that said first and second throttling valves (19, 19') are electromagnetically controlled.

3. The hydraulic circuit according to claim 1, characterized in that situated in said bypass (190, 190') of each throttling valve (19, 19'), among the throttling valves (19, 19') and the hydraulic cylinder (5), is a manual flow control valve (20, 20'), able to reduce farther adjustably a flow rate through the throttling valve (19, 19') of the fluid being discharged from the chamber that is at the moment in a low pressure, so that a back pressure is generated in said low pressure chamber.

4. The hydraulic circuit according to claim 3, characterized in that the throttled cross-section in the throttling valve (19) of the duct (10) communicating with the cylinder chamber (6) having the piston rod (4) is wider than the throttled cross section in the throttling valve (19') of the duct (11) communicating with the other cylinder chamber (7).

5. The hydraulic circuit according to claim 3, characterized in that said manual flow control valve (20, 20') comprises a dial (24) with a knob control (22) and a pointer (23) connected thereto to display the percentage reduction of required flow rate.

6. A hydraulic circuit for linearly driving a machine-tool slider in both directions, comprising:

a hydraulic cylinder (5) with a piston rod (4) connected to a slider that travels until a first predetermined position for each pass of working operation of a workpiece to be bent;

two chambers (6, 7) within the hydraulic cylinder, one of the two chambers having the piston rod (4);

two ducts (10, 11) providing a pressurized fluid, both of the two chambers (6, 7), in order to be in high and low pressure alternatively, communicating with respective ones of the two ducts (10, 11);

a three-position four-way valve (18) positioned operative on the two ducts (10, 11);

a check valve (12-13) positioned operative on the two ducts (10, 11), a first bypass (190) located between the check valve and the four-way valve and comprising a first throttling valve (19), the first throttling valve (19) operated to generate an increased pressure in a first of the two chambers (6, 7) which is at the moment in a low pressure, in order to slow down said slider in a first work motion when a programmable interval is approached from the first predetermined position for each working pass; and a second bypass located between the check valve and the four-way valve and comprising a second throttling valve (19') mounted symmetrically opposite to the first throttling valve (19) and operated to generate an increased pressure in a second of the two chambers which is at the moment in a low pressure, in order to slow down said slider in a second work motion when a programmable interval is approached from a second predetermined position for each working pass.

7. The hydraulic circuit according to claim 6, wherein, said first and second throttling valves (19, 19') are electromagnetically controlled.

8. The hydraulic circuit according to claim 6, further comprising a manual flow control valve (20, 20') situated in each of the first and second bypasses (190, 190'), each manual flow control valve (20, 20') able to adjustably reduce a flow rate through the throttling valve (19, 19') of the fluid being discharged from the chamber that is at the moment in a low pressure, so that a back pressure is generated in said low pressure chamber.

9. The hydraulic circuit according to claim 8, wherein, the throttled cross-section in the first throttling valve (19) of the duct (10) communicating with the cylinder chamber (6) having the piston rod (4) is wider than the throttled cross-section in the second throttling valve (19') of the duct (11) communicating with the other cylinder chamber (7).

10. The hydraulic circuit according to claim 8, wherein, each said manual flow control valve (20, 20') comprises a dial (24) with a knob control (22) and a pointer (23) connected thereto to display the percentage reduction of required flow rate.

* * * * *